United States Patent [19]

Hayashi

[11] 4,106,418

[45] Aug. 15, 1978

[54] ONE-STEP BUTTONHOLE MECHANISM FOR SEWING MACHINE

[75] Inventor: Yasuhisa Hayashi, Osaka, Japan

[73] Assignee: White Sewing Machine Company, Cleveland, Ohio

[21] Appl. No.: 718,810

[22] Filed: Aug. 30, 1976

[30] Foreign Application Priority Data

Sep. 11, 1975 [JP] Japan ..... 50-125221[U]

[51] Int. Cl.[2] ..... D05B 3/02; D05B 3/06

[52] U.S. Cl. ..... 112/158 B

[58] Field of Search ..... 112/158 B, 158 R, 77, 112/66, 65, 158 D

[56] References Cited

U.S. PATENT DOCUMENTS

| | | | |
|---|---|---|---|
| 3,090,334 | 5/1963 | Hayashi et al. | 112/158 B |
| 3,444,832 | 5/1969 | Gray | 112/158 B |
| 3,656,443 | 4/1972 | Ross | 112/158 B X |
| 3,841,246 | 10/1974 | Casner et al. | 112/158 B X |

*Primary Examiner*—Peter Nerbun

*Attorney, Agent, or Firm*—McNenny, Pearne, Gordon, Gail, Dickinson & Schiller

[57] ABSTRACT

A device in a domestic sewing machine for automatically sewing a buttonhole pattern in four successive stages comprising, in order, lock stitches at one end, stitches to one side, lock stitches at the other end, and finally stitches at the other side. Only a single manual step, that of presetting an adjustable element to program the desired length of the buttonhole, is required of the operator to condition the machine. The device includes a set of cams for controlling needle amplitude, lateral position or base line, and direction and rate of feed. The cams are rotationally driven by a pair of ratchet wheels in timed relation to the formation of stitches. Means are provided to alternately establish and interrupt the drive to the ratchet wheels, and therefore the cams, at certain times in the sequence to effect appropriate changes in the sewing pattern.

4 Claims, 12 Drawing Figures

Fig. 3
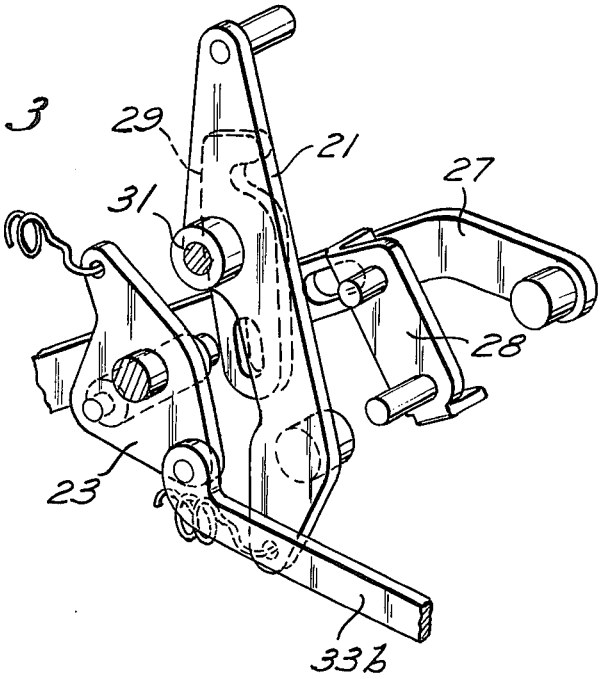
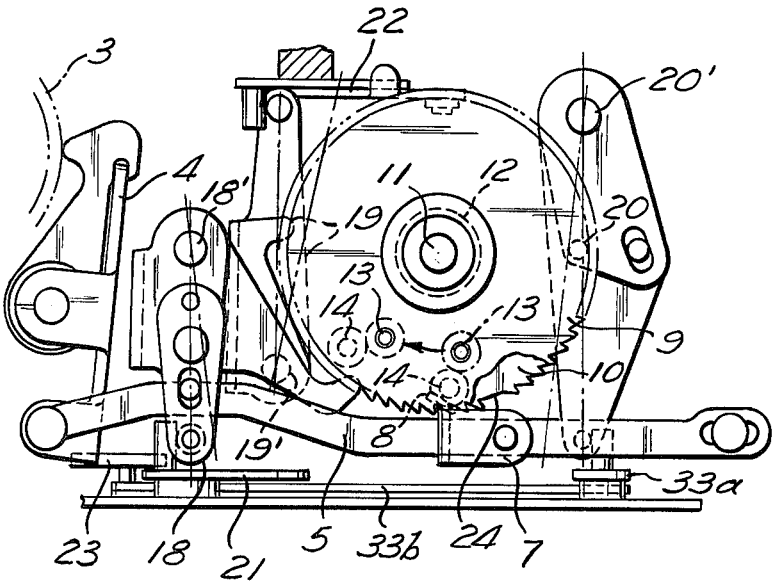
Fig. 4
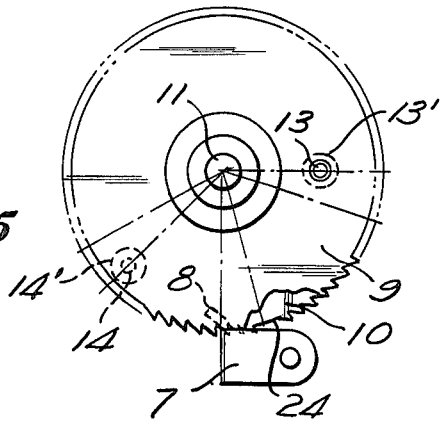
Fig. 5
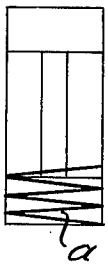
Fig. 5a

Fig. 6
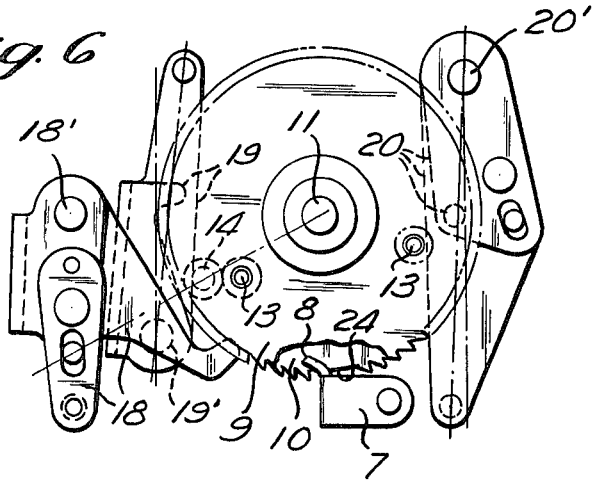
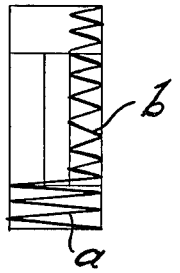
Fig. 6a
Fig. 7
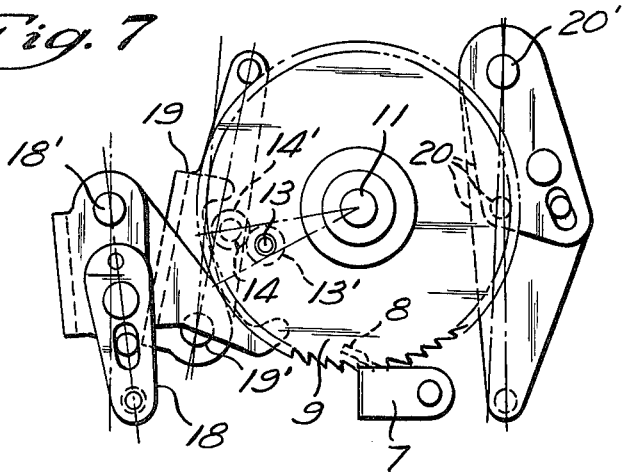
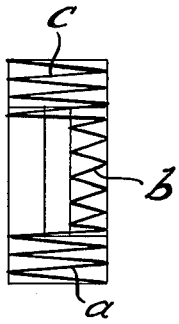
Fig. 7a
Fig. 8
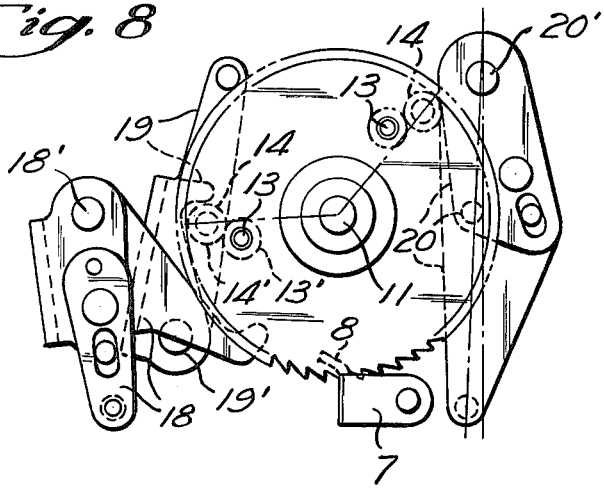
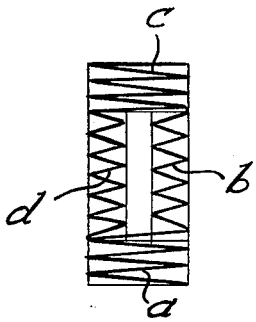
Fig. 8a

ONE-STEP BUTTONHOLE MECHANISM FOR SEWING MACHINE

BACKGROUND OF THE INVENTION

The invention relates to sewing machines and, in particular, to a mechanism for sewing buttonholes.

PRIOR ART

Domestic sewing machines in the past have incorporated various devices to carry out the sewing of buttonhole stitch patterns. Examples of such devices are disclosed, for example, in U.S. Pat. Nos. 3,090,334; 3,131,658; 3,148,645; 3,149,591; and 3,670,676. It is known from certain ones of these patents to produce a buttonhole stitch pattern by sewing a rectangular buttonhole outline in successive steps by combining end bar stitches of wide amplitude and limited feed and side stitches of slightly less than half amplitude and moderate feed. It is also known from particular ones of the aforementioned patents to control the stitching pattern and sequence by a bank of cams incrementally rotatable about a common axis and controlling the lateral stitch amplitude, base line or lateral offset of the stitching zone, and the combination of feed direction and rate. Typically, devices of the general type under consideration here have suffered from disadvantages, such as excessive machine complexity and the requirement of high operator dexterity, concentration, and intervention throughout the sewing sequence.

SUMMARY OF THE INVENTION

The invention provides a device for the fully automatic sewing of a buttonhole which requires only the simple manual adjustment of one element to selectively determine buttonhole length prior to initiation of sewing. The device includes a set of cams for determining lateral needle amplitude, base line or lateral needle position, and rate and direction of feed.

Control means of the device are arranged to produce a fixed number of bar end stitches in a first stage, side stitches variable in number according to the set position of the adjustment element and the desired length of buttonhole in the second stage, bar end stitches equivalent in number to the first number of bar end stitches in a third stage, and finally in a last stage an indefinite number of side stitches sufficient to make up a length equal to that of the preselected number of side stitches developed in the second stage.

As disclosed, the cams are rotationally driven through a ratchet mechanism which is arranged to count the formation of stitches for timing the transition between stages. During the relatively short periods of the bar end stitching, i.e., the first and third stages, the control cams are rotated by the ratchet mechanism. Alternately, during the variable and substantially longer stages of the side stitching, ratchet feed of the cams is interrupted. This intermittent rotation of the cams and continuous registering of the elapsed number of stitches is accomplished by use of two ratchet wheels. The first ratchet wheel, to which the cams are fixed, is stopped at the beginning of the second stage, while the second ratchet wheel continues rotation from initiation of sewing. When the accumulated number of stitches formed is equal to that required for the first and second stages, i.e., the stitches at one end and one side, the second ratchet wheel is caused to rotationally drive the cams through the first ratchet wheel. When the accumulated number of stitches reaches the number required for the additional third stage of end bar stitches, rotation of the cams is finally stopped.

BRIEF DESCRIPTION OF THE DRAWINGS

FIG. 3 is a fragmentary, perspective view illustrating the interrelationship of certain elements of the device of FIG. 1;

FIG. 4 is a plan view of a portion of the buttonhole sewing device of FIG. 1;

FIG. 5 is a plan view, with portions omitted, of the ratchet wheels and a forwarding claw of the device, and FIG. 5*a* is a schematic representation of a first stage of buttonhole sewing corresponding to the showing of FIG. 5;

FIGS. 6 and 6*a* illustrate the device at the time of the right edge sewing of the buttonhole and the sewing of the same as completed through the second stage;

FIGS. 7 and 7*a* show the device at the time when lock sewing at the end of the buttonhole is being carried out and the completion of the end of the buttonhole, respectively; and FIGS. 8 and 8*a* show the device at the time of left edge sewing of the buttonhole and its completed state, respectively.

DETAILED DESCRIPTION OF THE PREFERRED EMBODIMENT

Figure 1:
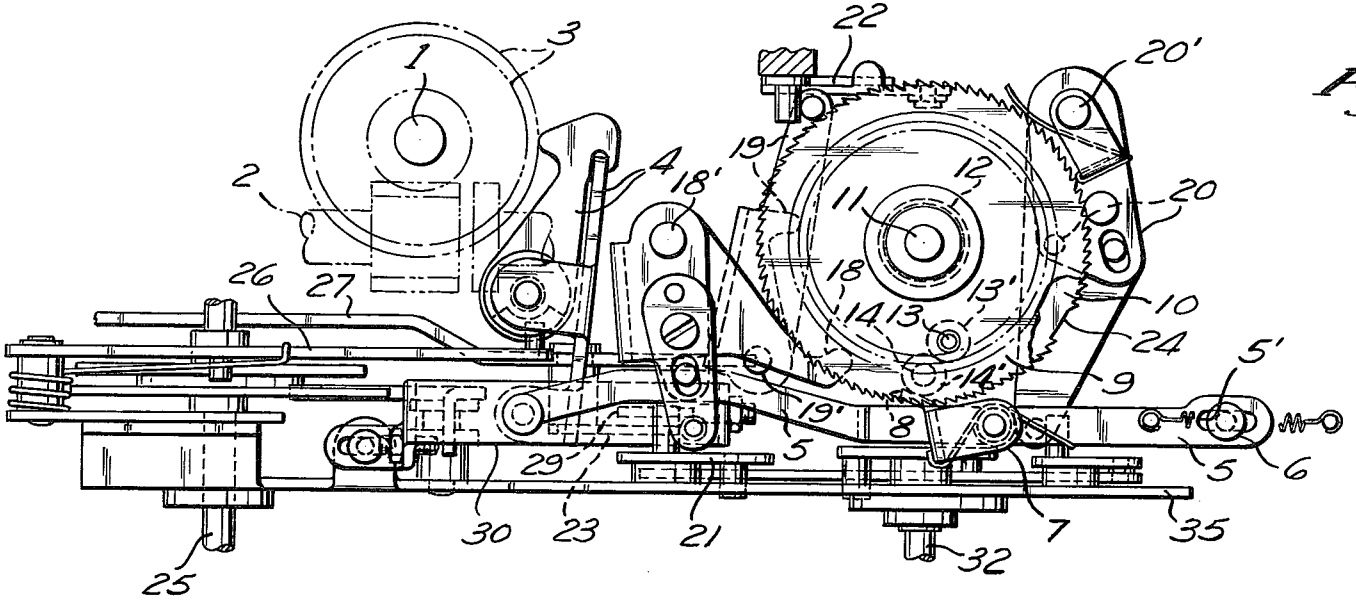
FIG. 1 is a plan view of a buttonhole sewing device constructed in accordance with the invention.

A pattern camshaft 1 rotates in conformity with a conventional upper shaft 2. A zig-zag sewing cam 3 is fixed to the camshaft 1, while one end of a contact or cam follower element 4 oscillates in contact with the cam. A connecting lever or link 5 is horizontally installed by pin joining one end to the other end of the contact element 4, passing a screw 6 through an elongated hole 5' which is formed at the other end, and making it possible to freely slide in the left and right directions at the upper part of the frame F. A U-shaped forwarding claw or pawl 7 has its base or side portions pivoted to the upper surface of the connecting lever 5. A protrusion 8 extends laterally from the tip of this forwarding claw 7. Two ratchet wheels 9 and 10 have the same diameter and are disposed with their peripheral gear or toothed surfaces at a position where the tip of the forwarding claw 7 is adapted to contact them while being freely rotatable on a support shaft 11. The ratchet wheels 9 and 10 are relatively supported, up and down, at a prescribed height, the upper wheel being resiliently vertically supported by a coil-shaped spring 12 which is disposed between both of the ratchet wheels 9 and 10. A pin 13, with a head 13' has its base fixed to the reverse or lower side of the upper wheel 9, as shown in the drawings, and another pin 14, with a head 14', is fixed to the upper surface of the lower ratchet wheel 10.

The heads 13' and 14' of the aforementioned pair of pins are formed in such a manner that, at the time when one (the upper) of the aforementioned two ratchet wheels 9 and 10 is rotated, the head portion 13' of the pin 13, which is fixed to the upper wheel, is made to contact, from the side, the head part 14' of the pin 14 of the other or lower ratchet wheel and thereby rotate the other ratchet wheel. At the same time when the upper ratchet wheel 9 is manually pushed down in opposition to the aforementioned coil-like spring 12, the contact of the aforementioned head parts 13' and 14' is avoided, thereby making it possible for the wheel 9 alone to be rotated Further, at the time when the pin 14, which rotates along with the lower ratchet wheel 10, has reached the tip of the aformentioned forwarding claw, its head 14' engages the protuberance 8 at the tip of the forwarding claw 7 so as to make the forwarding claw 7 escape outwardly.

Three cams 15, 16, and 17 are fixed on the lower or reverse side of the aforementioned lower ratchet wheel 10 so as to work as a unit, with each cam having high and low positions, which are required for buttonhole sewing, formed for each prescribed angle of rotation of its respective peripheral edge. In order from the top of FIG. 2, they are the base line changing cam 15, the forward changing cam 16, and the amplitude changing cam 17.

A contact element or cam follower 18 for changing the base line has a fulcrum shaft 18' and has one end engaged with the base line changing cam 15. A similar contact element 19 has a fulcrum shaft 19' and has its end engaged with the forward changing cam 16 in a like manner. A contact element 20 has a fulcrum 20' and is engaged with the amplitude changing cam 17.

The other ends of the aforementioned contact elements 18, 19 and 20 are either directly or indirectly connected with the base line changing lever 21, the forward changing lever 22, and the amplitude changing lever 23, respectively, which are conventionally provided on the zig-zag sewing machine and modify the movement of a needle bar and forward gear or work feed device (which are omitted from the drawings) in conformity with changes made by the aforementioned three cams 15, 16, and 17 for the buttonholes.

A limited area 24 on the periphery of the lower ratchet wheel 10 to which the three cams 15–17 are affixed is formed without teeth. This cut tooth portion 24 is provided at an angular position where it reaches the location of the aforementioned forwarding claw 7 and thereby stops the rotation of the ratchet wheel 10 when, by the actions of the aforementioned cams 15–17 and the action of each of the contact elements 18–20, which contact the same, the initial stage of buttonhole sewing for the buttonhole has been completed.

Figure 2:
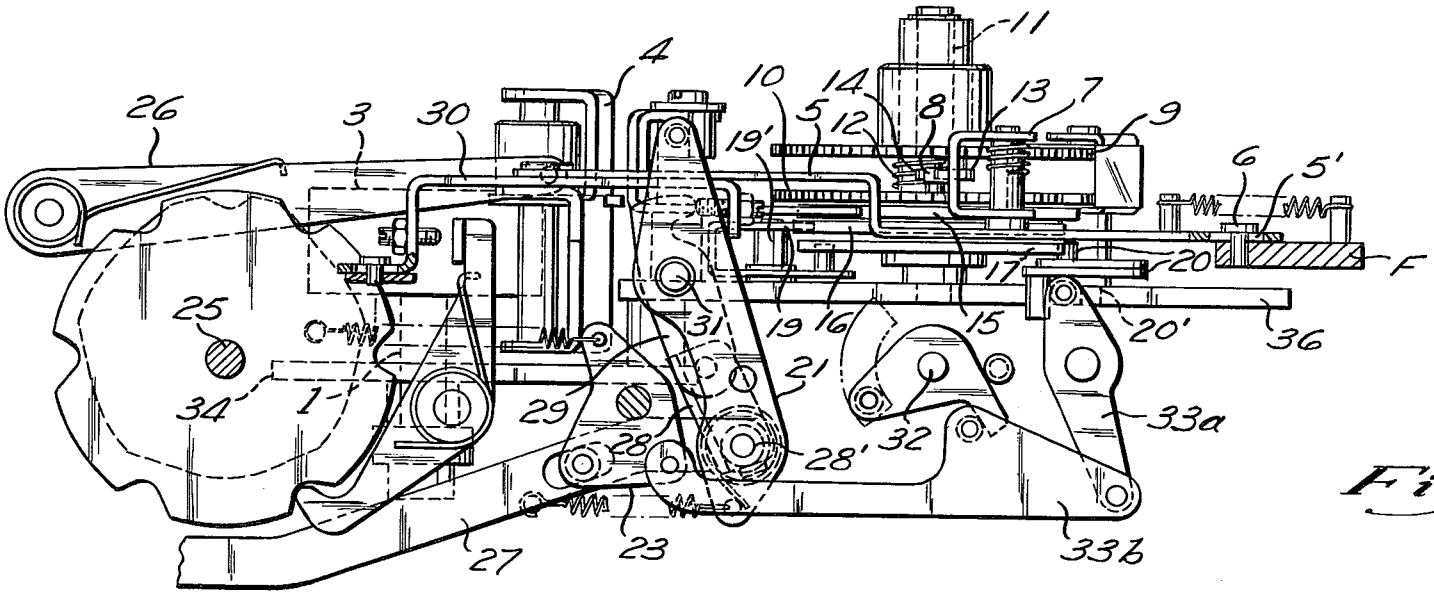
FIG. 2 is an elevational view of the device of FIG. 1.

In FIGS. 1 and 2, additionally there is shown a pattern selection operating shaft 25 and a pattern selection lever 26. An amplitude rod 27 connected at one end to the needle bar receives at the other end an amplitude changing lever 23 into an intermediate oblong hole, thereby transmitting the amplitude to the needle bar. An oscillating case 28 (FIG. 3) is engaged with the tip of the amplitude rod 27 and is pivotally fixed to the aforementioned base line changing lever 21. A zig-zag transmission lever 29 at one end receives the free tip of the oscillating case 28 in an oblong hole and at its other end engages the terminal of a zig-zag transmission rod 30 which is connected to the contact element 4, along with the connecting lever 5, for the sewing of the aforementioned buttonhole.

The lever 29 is pivoted to the frame F together with the aforementioned base line changing lever 21 at a shaft 31. An amplitude operating shaft 32 is manually operated by a control knob (not shown) on the face of the machine. Transmission elements **33*a* and 33*b* are provided between the contact element 20 for the amplitude modification of the aforementioned operating shaft 32 and the aforementioned buttonhole and amplitude modification lever 23**.

Many of the aforementioned members are the same as those used in the known structure of conventional sewing machines, as stated earlier, and therefore a detailed explanation of these will be omitted from this specification. In addition, a support plate 34 supports the cam device, a support plate 35 supports the operating shafts 25 and 32, etc., and a support plate 36 supports the buttonhole cam device.

Below, buttonhole sewing carried out by the device constructed in the manner described above is explained. With reference to FIG. 1, the upper ratchet wheel 9 is manually rotated by the operator grasping a control knob fixed to this ratchet wheel and exposed at the upper side of the machine, through a certain angle in the clockwise direction, as shown in FIG. 4, beyond the position where the lower pin 14 engages the protuberance 8 where it disenables the forwarding claw 7 so that the contact between the protuberance and the head 14' of the pin is broken, with the result that the forwarding claw assumes an operating posture.

Meanwhile, the other ratchet wheel 10 is also manually rotated by the contact of the pins 13 and 14 so that the buttonhole cams 15–17 change the position of the contact elements 18–20, respectively, as shown by the dotted lines in FIG. 4, moving the base line changing lever 21 to the right base line position, placing the forward changing lever 22 at a retrogressed position and, at the same time, thereby placing the cloth forwarding amount of the feed rate at a position of approximately zero and changing the amplitude changing lever 23 to a position where the amplitude becomes a maximum.

Furthermore, the cut toothed portion 24, formed on the peripheral portion of the aforementioned lower ratchet wheel 10, is positioned at this particular time several teeth behind the forwarding claw 7 with reference to the direction of rotation, as shown in FIG. 4, as compared with the operating position of the forwarding claw 7.

Next, in completing manual set-up of the machine, the upper ratchet wheel 9, i.e., the one to which the cams are not fixed, is manually pushed down in opposition to the spring 12 to position its pin head 13' below the other pin head 14' and at the same time is rotated in the clockwise direction in FIG. 4, which the result that this upper ratchet wheel is angularly displaced from the roller wheel to the position of FIG. 5. The angle of rotation at the time when the aforementioned wheel 9 alone is turned is made smaller when the length of the buttonhole becomes long and is made larger when the length of the same becomes short.

Stated in other words, the disclosed device requires manual intervention only once in its preparation for sewing a complete buttonhole pattern. This manual action comprises manual turning of both ratchet wheels to a point where the missing teeth portion 24 of the lower ratchet wheel 10 is near but slightly trailing the claw 7 in the direction of rotation, subsequent depression of the upper wheel 9 to release it from the lower wheel and a further turning of the upper wheel through an angular displacement inversely proportional to the desired length of a buttonhole.

When the sewing machine is operated from the aforementioned set state (the state shown in FIG. 5), the connecting lever 5 reciprocates right and left in conformity with the contact element 4, which oscillates in conformity with the zig-zag sewing cam 3, with a result that the forwarding claw 7 advances the upper and lower ratchet wheels 9 and 10 simultaneously, one tooth at a time, in increments proportional in number to stitches carried out by the machine. At the time when the cut tooth part 24 of the lower ratchet wheel 10 is positioned at the forwarding claw 7, the rotation of this wheel is terminated, during which time, as shown in FIG. 5*a*, the sewing of the lock stitches *a* on this first end of the buttonhole or the sewing at the right base line, the amplitude maximum, retrogression in the direction of the cloth movement and feed rate of almost zero is completed.

The speed rate or ratio between the upper shaft 2 and the zig-zag camshaft 1 in this example is such that the needle bar will carry out two stitches (one zig-zag reciprocating movement) during the time when a ratchet 9,10 is forwarded by one tooth.

Immediately prior to the contact of the forwarding claw 7 with the aforementioned cut toothed portion 24, further, the low locations of the forward changing cam 16 and the amplitude changing cam 17 among the three cams for the buttonhole are effective, the respective contact elements 19 and 20 change their positions as shown by the dotted lines in FIG. 6, a modification being thereby made to sewing in the reverse direction, the amount of the movement being increased to a moderate level and the amplitude being reduced to a lower level while the right base line is being maintained. This stage is maintained until the upper ratchet wheel 9 advances through the selected angle as determined by its earlier manual setting and the pin 13, which is shown by the dotted line in FIG. 6, engages and moves the pin 14 along with the rotation of the ratchet wheel. While the upper ratchet 9 advances alone, as shown in FIG. 6*a*, the right edge sewing *b* of the buttonhole is carried out.

As a result of the lower wheel 10, and therefore the cams, being rotated by engagement between the pins 13 and 14, the contact element 18 for the modification of the base line, the contact element 19 for the modification of feed, and the contact element 20 for the modification of the amplitude effect, the position changes as shown by the dotted lines in FIG. 7. Thus, the sewing action of the sewing machine is modified to the left base line, with a feed in the forward direction, the rate of feed nearly zero and the maximum amplitude. At this time, as is shown in FIG. 7*a*, lock sewing at the buttonhole end *c* is carried out.

The aforementioned lock or bar end sewing *c* is accomplished during the time when the same number of ratchet teeth, as in the case of lock sewing *a* on the front end, which was described earlier, are indexed or forwarded by the claw 7.

When the lock sewing of the buttonhole end *c* is completed, sewing is modified to forward, moderate cloth feed movement and reduced amplitude, while the left base line is maintained, by actions of the contact element 20 for the modification of the amplitude and through the action of the cams 16 and 17. As shown in FIG. 8*a*, left edge sewing is carried out at *d*. It is mentioned in this connection that left edge sewing *d* is finished and termination of the operation of the sewing machine is reached at the time when its length becomes equal to or greater than the right edge sewing *b*. The above sequences completes the sewing of one buttonhole.

As stated above, it is possible by this design to suitably change the length of the buttonhole in accordance with the initial angular setting given to the upper ratchet wheel and complete the sewing sequence through one cycle, including the lock sewing at both ends of the buttonhole and through the edge sewing on both right and left sides with a one-touch setting operation prior to sewing, thereby making it extremely easy to operate the sewing machine.

Although a preferred embodiment of this invention is illustrated, it is to be understood that various modifications and rearrangements of parts may be resorted to without departing from the scope of the invention claimed herein.

What is claimed is:

1. In a sewing machine, a device for sewing buttonholes through a continuous sequence of four stages controlled by the machine, comprising a plurality of rotary cams fixed relative to one another for controlling the position of amplitude, base line, and feed modifying elements, means for rotating said cams in incremental steps proportional in number to stitches, control means including means to interrupt stepwise rotation of said cams at the completion of the first stage of sewing through a predetermined fixed number of stitches and the initiation of the second stage, said control means including a manually adjustable element settable prior to initiation of sewing to re-establish stepwise rotation of said cams at the completion of a second stage of sewing through a variable predetermined number of stitches, said control means including means to interrupt stepwise rotation of said cams at the completion of a third stage of sewing through a second predetermined fixed number of stitches, said cams being arranged to produce a high amplitude and minimal feed during the first stage of sewing, a reduced amplitude, a base line to one side and moderate feed in one direction during the second stage of sewing, a high amplitude and minimal feed during the third stage of sewing, and a reduced amplitude, a base line to the side opposite said one side and a moderate feed in a direction opposite said one direction during the sewing of the fourth stage, wherein said control means includes a ratchet wheel, said cam rotating means including a pawl for advancing said ratchet wheel in timed relation to the formation of stitches, said ratchet wheel being arranged to rotationally drive said cams, said first-mentioned interrupting means including means to prevent said pawl from advancing said ratchet wheel.

2. A device as set forth in claim 1, wherein said manually adjustable element is a second ratchet wheel, and means on said second wheel to drive said first-mentioned wheel during the third stage of sewing.

3. A device as set forth in claim 2, wherein both of said ratchet wheels are adapted to be engaged and driven by said pawl.

4. A device as set forth in claim 3, wherein said second-mentioned interrupting means includes means to disenable said pawl from advancing both of said ratchet wheels.

* * * * *